United States Patent [19]

Korenberg et al.

[11] Patent Number: 4,920,925

[45] Date of Patent: May 1, 1990

[54] BOILER WITH CYCLONIC COMBUSTION

[75] Inventors: Jacob Korenberg, York, Pa.; Mark Khinkis, Morton Grove, Ill.

[73] Assignee: Donlee Technologies Inc., York, Pa.

[21] Appl. No.: 332,395

[22] Filed: Mar. 29, 1989

Related U.S. Application Data

[63] Continuation of Ser. No. 186,734, Apr. 22, 1988, abandoned, which is a continuation of Ser. No. 928,096, Nov. 7, 1986, abandoned.

[51] Int. Cl.[5] ..... F22B 7/12

[52] U.S. Cl. ..... 122/149; 110/264; 122/182.5; 122/136 R

[58] Field of Search ..... 110/264; 122/4 D, 44 R, 122/51-53, 55, 74-76, 110, 45, 47, 136 R, 140 R, 140 A, 147, 149, 156, 182 R, 182 S, 183; 431/173, 177; 126/350 R

[56] References Cited

U.S. PATENT DOCUMENTS

| | | | |
|---|---|---|---|
| 2,097,104 | 10/1937 | Saha . | |
| 2,800,091 | 7/1957 | Lotz et al. | 431/173 |
| 3,048,215 | 8/1962 | Huckabee | 431/173 |
| 3,105,540 | 10/1963 | Hardgrove . | |
| 3,596,639 | 8/1971 | Hemmert | 122/149 |
| 3,974,021 | 8/1976 | Bernadiner et al. . | |
| 4,218,426 | 8/1980 | Dahmen | 110/345 X |
| 4,457,289 | 7/1984 | Korenberg | 122/4 D |
| 4,470,359 | 9/1984 | Smith | 122/52 X |
| 4,488,514 | 12/1984 | de Poray et al. | 122/136 R X |
| 4,565,137 | 1/1986 | Wright | 110/264 |
| 4,574,711 | 3/1986 | Christian | 110/264 |
| 4,627,388 | 12/1986 | Buice | 122/149 |

OTHER PUBLICATIONS

Incinerators for Waste Waters, A. P. Shurigin, M. N. Bernadiner, Technika, pp. 8-15, 18-35, 66-69, 136-143, and 180-185 (Kiev, 1978).

Cyclone Melting in Iron Metallurgy, Technika, p. 53 (Kiev, 1975).

Waste Energy Resource of Industry and Energy—Technological Integration, N. A. Semenenko, Energy, pp. 284-285 (Moscow, 1968).

Cyclotherm Packaged Boilers, Cyclotherm Division, Oswego Package Boiler Co., Inc., (Oswego, N.Y.) (Sales Brochure).

Combustion in Swirling Flows, N. Syred, (1974) pp. 143-201, vol. 23.

*Primary Examiner*—Edward G. Favors

*Attorney, Agent, or Firm*—Finnegan, Henderson, Farabow, Garrett & Dunner

[57] ABSTRACT

A boiler with a cyclonic combustor includes a first chamber which is substantially uncooled and refractory lined, a second chamber in fluid communication with the first chamber, ducts for supplying air and fuel directly into the first chamber and for forming a cyclonic flow pattern of hot gases for combustion within the first and second chambers, an exit throat at the end of the second chamber and a heat exchanger surrounding the second chamber for keeping low combustion temperature in both chambers.

14 Claims, 2 Drawing Sheets

BOILER WITH CYCLONIC COMBUSTION

This application is a continuation, of application Ser. No. 07/186,734, filed Apr. 22, 1988, which is a continuation of Ser. No. 928,096, filed Nov. 7, 1986, all abandoned.

BACKGROUND OF THE INVENTION

1. Field of the Invention

The present invention relates to boilers having cyclonic combustion.

2. Description of the Related Art

In the past, cyclone combustors have been used to produce a cyclone of turbulent gases within a combustion chamber for combusting various solid materials, including poor quality coal and vegetable refuse. Such combustors are disclosed in "Combustion in Swirling Flows: A Review", N. Syred and J.M. Beer, Combustion and Flame, Volume 23, pages 143–201 (1974). A fluidized bed boiler having a cyclonic combustor is disclosed in U.S. Pat. No. 4,457,289 to Korenberg. These documents are incorporated by reference in this application. A fire tube boiler having a cyclonic combustor has been commercially marketed by Cyclotherm Division, Oswego Package Boiler Co., Inc.

Although providing high specific heat release, known adiabatic cyclone combustors have the disadvantages that combustion temperature is high and $NO_x$ emissions are high. Combustion is unstable at low capacity burning and high hydrodynamic turndown ratios are not possible in non-adiabatic combustors.

The hydrodynamic turndown ratio of the boiler is defined as the ratio of pressurized air flow at maximum load to pressurized air flow at minimum load and measures the ability of the boiler to operate over the extremes of its load ranges. A high turndown ratio would allow a wide range in the level of steam generation at a particular time. A wide range of steam generation is important to most efficiently allow the boiler to respond to varying steam demands.

It is an object of the present invention to provide a boiler utilizing cyclonic combustion and having a very high specific heat release, low excess air and a relatively low combustion temperature at low CO and $NO_x$ emissions.

It is also an object of the present invention to provide a boiler utilizing cyclonic combustion and which is stable at low capacity burning.

It is another object of the present invention to provide a boiler utilizing cyclonic combustion and having a high turndown ratio.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a boiler having a cyclonic combustor, comprising a first chamber having a front end, a rear end and a substantially cylindrical longitudinally extending outer wall which is substantially uncooled and refractory lined; a second chamber having a front end, a rear end, and a substantially cylindrical longitudinally extending outer wall, the rear end of the first chamber in fluid combination with and substantially longitudinally aligned with the front end of the second chamber; means for supplying air and fuel directly into the first chamber and for forming a cyclonic flow pattern of hot gases for combustion within the first chamber and the second chamber; a substantially cylindrical exit throat at the rear end of the second chamber aligned substantially concentrically therewith for exhausting hot gases from the second chamber, the exit throat having a diameter less than the inner diameter of the second chamber; and heat exchange means surrounding the second chamber for substantially cooling the wall of the second chamber without substantially cooling the wall of the first chamber.

BRIEF DESCRIPTION OF THE DRAWINGS

The accompanying drawings, which are incorporated in and constitute a part of the specification, illustrate preferred embodiments of the invention and, together with the general description given above and the detailed description of the preferred embodiments given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention, there is provided a boiler having a cyclonic combustor comprising a first chamber having a front end, a rear end and a substantially cylindrical longitudinally extending outer wall which is substantially uncooled and refractory lined; a second chamber having a front end, a rear end and a substantially cylindrical longitudinally extending outer wall, the rear end of the first chamber in fluid communication with and substantially longitudinally aligned with the front end of the second chamber; means for supplying air and fuel directly into the first chamber and performing a cyclonic flow pattern of hot gases for combustion within the first chamber and the second chamber; a substantially round exit throat at the rear end of the second chamber and aligned substantially concentrically therewith for exhausting hot gases from the second chamber, the exit throat having a diameter less than the inner diameter of the second chamber; and heat exchange means surrounding only the second chamber for substantially cooling the wall of the second chamber without substantially cooling the wall of the first chamber.

Figure 1:
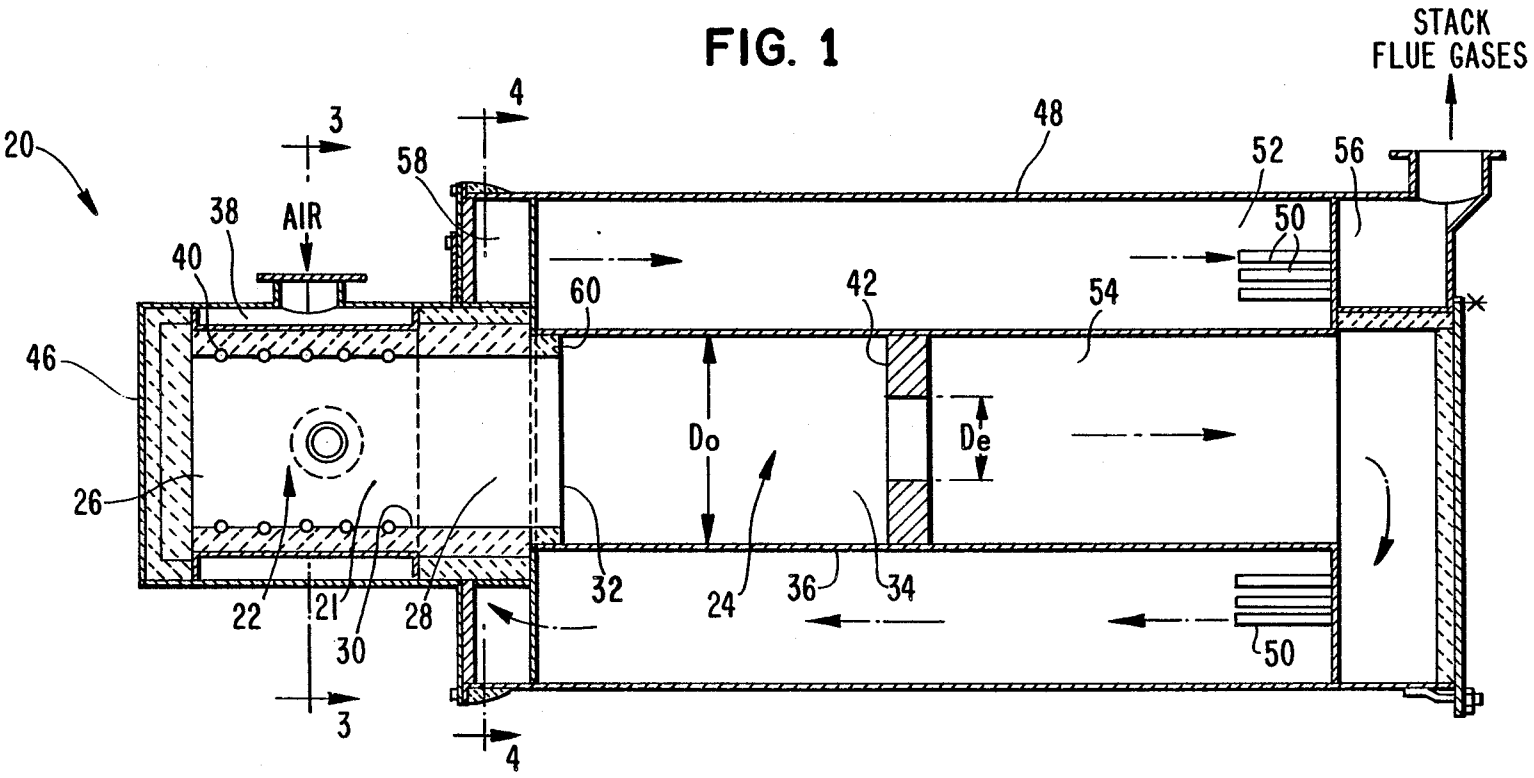
FIG. 1 is a side elevation in cross section of a first embodiment of a boiler incorporating the teachings of the present invention.
Figure 2:
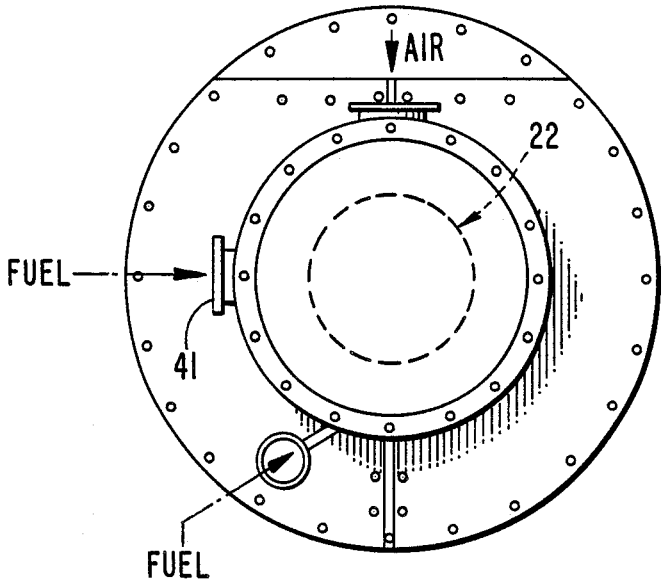
FIG. 2 is an end view of the boiler illustrated in FIG. 1.

FIG. 1 shows a horizontally disposed fire tube boiler having a cyclonic combustor in accordance with one preferred embodiment of the invention. The combustor includes a central fire tube, also known as a Morison tube, with a combustion chamber 21 including areas defined by first chamber 22 and second chamber 24.

First chamber 22 includes a front end 26, a rear end 28 and a substantially cylindrical longitudinally extending outer wall 30 which is substantially uncooled and refractory lined.

Second chamber 24 has a front end 32, a rear end 34 and a substantially cylindrical longitudinally extending outer wall 36, which is preferably constructed of metal. The rear end 28 of the first chamber 22 and the front end 32 of second chamber 24 are in fluid communication and longitudinally aligned with each other.

Means for supplying air and fuel directly into first chamber 22 such as plenum or manifold 38 and tangential nozzles 40 form a cyclonic flow pattern of hot gases within the reaction chamber defined by first chamber 22 and second chamber 24. The fuel, which is preferably liquid or gaseous, is introduced tangentially by nozzles 43 and may additionally or alternatively be introduced into first chamber 22 radially by nozzle 41. A substantially cylindrical exit throat 42 is positioned at rear end 34 of second chamber 24 and aligned concentrically with second chamber 24 so that the exit throat has a diameter less than the inner diameter of second chamber 24. As embodied herein, a source of pressurized air such as a blower (not shown) feeds air from plenum or manifold 38 through nozzles 40 into the first chamber 22.

In accordance with the invention, it is critical that the cross sectional area of the tangential air nozzles 40 and the geometric characteristics of first chamber 22 and second chamber 24 be adapted to provide a Swirl number (S) of at least about 0.6 and Reynolds number (Re) of at least about 18,000 which are required to create a cyclone of turbulence in first chamber 22 and second chamber 24 when operating at maximum capacity. On the other hand, the Swirl number and Reynolds number at maximum capacity must not exceed those values which would result in an unacceptable pressure drop through the tangential air nozzles 40 and the combustion chamber constituted by first chamber 22 and second chamber 24.

It is the cyclone of turbulence which enables the achievement of specific heat release values up to and higher than $3.5\times10^6$ Kcal per cubic meter per hour and $NO_x$ concentration in flue gases of about 60–120 ppm and about 120–180 ppm when firing natural gas and light fuel oil, respectively. Exit throat 42 and the interior of second chamber 24 must exhibit certain geometric characteristics together with the cross sectional area of the tangential air nozzles of first chamber 22 in order to provide the requisite Swirl and Reynolds number.

All of the above-noted features are explained in greater detail below and are discussed generally in the article by Syred and Beer mentioned above, and the references noted in that article which are hereby incorporated by reference.

If the combustion chamber 21 comprising first chamber 22 and second chamber 24 is designed and operated so as to achieve a Swirl number of at least about 0.6 and a Reynolds number of at least about 18,000 in such chamber and the ratio of the diameter of the exit throat 42 (De) to the diameter of the inner wall of the second chamber 24 (Do), i.e., De/Do defined herein as X, lies within the range of about 0.4 to about 0.7, the first chamber 22 and second chamber 24 will, during operation, exhibit large internal reverse flow zones with as many as three concentric toroidal recirculation zones being formed. Such recirculation zones are known generally in the field of conventional cyclone combustors. This coupled with the high level of turbulence results in significantly improved heat exchange and, therefore, a relatively uniform temperature throughout combustion chambers 22 and 24.

The value of ratio X preferably lies within the range of about 0.4 to about 0.7 because as X increases, the pressure drop decreases through the combustion chamber and the Swirl number increases. Higher values of X are preferred. However, for values of X in excess of 0.7, the internal reverse flow zones are not formed sufficiently.

Heat exchange means surround second chamber 24 for substantially cooling the wall 36 of second chamber 24 without substantially cooling the wall 30 of first chamber 22. The heat exchange means preferably includes an outer boiler shell 48, gas tubes 50 between outer shell 48 and Morison tube 54 for conducting hot gases from second chamber 24, and space 52 within shell 48 outside gas tubes 50 and second chamber 24 for conducting water which is heated by the heated gases in the second chamber 24 and the gas tubes 50, all in a conventionally known manner.

Stable combustion, even at low boiler capacity, is achieved by not cooling the walls of first chamber 22 where the air and fuel are injected, but cooling only the walls of the second chamber 24. This stable combustion enables high turndown ratios to be accomplished. For example, as a result of this construction, the turndown ratio can be increased from 4:1 up to and higher than 10:1. Excess air can be decreased from 25–30% to 5% and kept constant at 5% over the high turndown ratio of 10:1. The flame temperature can be decreased to 2000° F. and lower, as opposed to about 3000° F. for conventional fire tube boilers. Therefore $NO_x$ emission is lower than in the standard burner/boiler unit due to the lower flame temperature and lower excess air.

The central fire tube preferably includes a cylindrical tube 54 extending from, aligned and continuous with wall 36 of second chamber 24. Hot gases from the second chamber 24 pass through exit throat 42 into cylindrical tube 54.

The heat exchange means also preferably includes means such as rear compartment 56 for directing the flow of hot gases exiting cylindrical tube 54 from second chamber 24 through a first predetermined set of the gas tubes 50 such as those in the lower part of FIG. 1 and front compartment 58 for directing the hot gases from the first set of gas pipes 50 to a second set of gas pipes 50 in the upper portion of FIG. 1 in the opposite direction. This is shown by the arrows indicating gas flow and is conventionally known for fire tube boilers.

Figure 3:
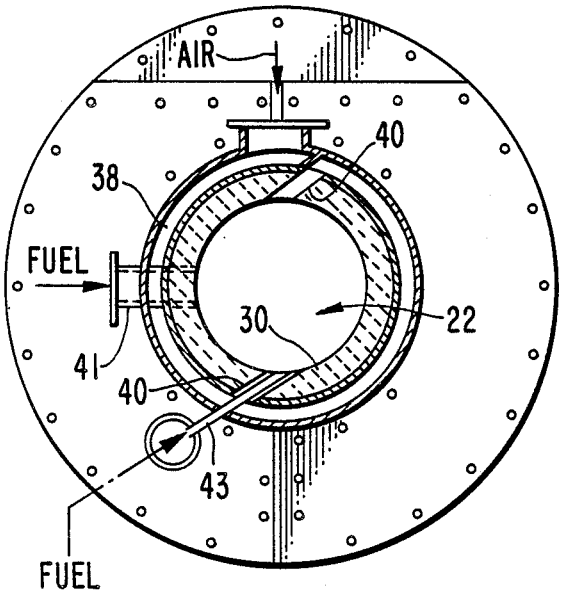
FIG. 3 is a cross section view taken along line B—B of FIG. 1.
Figure 4:
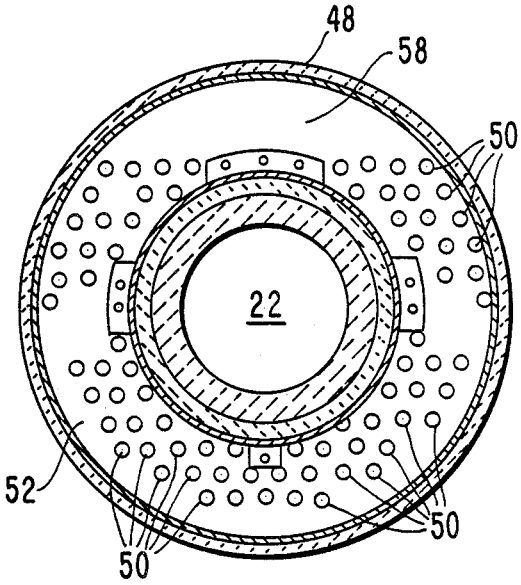
FIG. 4 is a cross section view taken along line C—C of FIG. 1.

As shown in FIG. 3, the means for supplying air and fuel preferably includes separate conduits for supplying air and fuel separately and directly into first chamber 22 and for mixing and combusting them in the first and second chambers 22 and 24.

The ratio between the length of the first and second chamber 22 and 24 affects the combustion temperature within the combustion chamber 21. In general, as the length of first chamber 22 decreases relative to the length of second chamber 24 the combustion temperature decreases. This ratio is important because lowering the combustion temperature lowers the $NO_x$ formation. This ratio for natural gas and fuel oil is normally less than 1.5 for a low capacity combustor and can become less than 0.5 for a very high capacity combustor. It is preferable that the first to second chamber length ratio is substantially in the range of about 0.2:1 to 1.5:1. Because of this, the combustion temperature can be less than 2000–2200° F. even for high capacity combustion.

In order to prevent damage to metal wall 36 of second chamber 24 due to overheating, the front end portion 32 of wall 36 is lined with a refractory material 60.

Although it is preferable that the cyclonic combustor described above be positioned within a boiler system, it is contemplated that it can be used for purposes of combustion or reaction without substantial boiler apparatus. Such a cyclonic combustion comprises a first chamber having a front end, a rear end and a substantially cylindrical longitudinally extending outer wall which is substantially uncooled and refractory lined; a second chamber having a front end, a rear end and a substantially cylindrical longitudinally extending outer wall, the rear end of the first chamber in fluid communication with and longitudinally aligned with the front end of the second chamber; means for supplying air and fuel directly into the first chamber and for forming a cyclonic flow pattern within the first chamber and the second chamber; a substantially cylindrical exit throat at the rear end of the second chamber and aligned substantially concentrically therewith, the exit throat having a diameter less than the inner diameter of the second chamber; and means for substantially cooling the wall of the second chamber without substantially cooling the wall of the first chamber.

Additional advantages and modifications will readily occur to those skilled in the art. The invention in its broader aspects is, therefore, not limited to the specific details, representative apparatus, and illustrative examples shown and described. Accordingly, deparatures may be made from such details without departing from the spirit or the scope of applicant's general inventive concept.

What is claimed is:

1. A boiler having a cyclonic combustor, comprising:

A first chamber having a front end, a rear end and a substantially cylindrical longitudinally extending outer wall which is substantially uncooled and refractory lined;

a second chamber having a front end, a rear end and a substantially cylindrical longitudinally extending outer wall, the rear end of the first chamber in fluid communication with and substantially longitudinally aligned with the front end of the second chamber;

means for supplying air and fuel directly into the first chamber and for forming a cyclonic flow pattern of hot gases for combustion within the first chamber and the second chamber;

a substantially cylindrical exit throat at the rear end of the second chamber and aligned concentrically therewith for exhausting hot gases from the second chamber, the exit throat having a diameter less than the inner diameter of the second chamber for inducing reverse flow zones within the first and second chambers; and heat exchange means surrounding the second chamber for substantially cooling the wall of the second chamber without substantially cooling the wall of the first chamber.

2. The boiler of claim 1 including a substantially cylindrical tube extending from the rear end of the second chamber and substantially longitudinally aligned with the second chamber.

3. The boiler of claim 1 wherein the supplying means includes means for separately supplying air and fuel directly into the first chamber and for mixing and combusting them in the first and second chambers.

4. The boiler of claim 3 wherein the air supplying means and the fuel supplying means are concentric nozzles for tangentially injecting air and fuel into the first chamber.

5. The boiler of claim 1 wherein the first to second chamber length ratio is substantially in the range of about 0.2:1 to 1.5:1.

6. The boiler of claim 1 wherein the front end of the outer wall of the second chamber is lined with refractory material.

7. A fire tube boiler comprising:

a first chamber having a front end, a rear end and a substantially cylindrical longitudinally extending outer wall which is substantially uncooled and refractory lined;

a second chamber having a front end, a rear end and a substantially cylindrical longitudinally extending outer wall, the rear end of the first chamber in fluid communication with and substantially longitudinally aligned with the front end of the second chamber, the second chamber comprising at least a portion of the boiler fire tube;

means for supplying air and fuel directly into the first chamber and for forming a cyclonic flow pattern of hot gases for combustion within the first chamber and the second chamber;

a substantially cylindrical exit throat at the rear end of the second chamber and aligned substantially concentrically therewith, the exit throat having a diameter less than the inner diameter of the second chamber for inducing reverse flow zones within the first and second chambers; and heat exchange means surrounding the second chamber for substantially cooling the wall of the second chamber without substantially cooling the wall of the first chamber, the heat exchange means including an outer shell, gas tubes between the outer shell and the second chamber for conducting hot gases from the second chamber, and space within the shell outside the gas tubes and the second chamber for conducting water which is heated by the heated gases in the second chamber and the gas tubes.

8. The boiler of claim 7 wherein the heat exchange means includes means for directing the flow of the hot gases from the second chamber through a first predetermined set of the gas tubes and back through a second predetermined set of the gas tubes.

9. The boiler of claim 7 including a substantially cylindrical tube extending from the rear of the second chamber and substantially longitudinally aligned with the second chamber.

10. The boiler of claim 9 wherein the fire tube comprises the second chamber and the substantially cylindrical tube and wherein the heat exchange means includes means for directing the flow of hot gases from the cylindrical tube through the gas tubes.

11. The boiler of claim 7 wherein the gas tubes longitudinally extend parallel to the second chamber.

12. A boiler having a cyclonic combustor, comprising:

a first chamber having a front end, a rear end and a substantially cylindrical longitudinally extending outer wall which is substantially uncooled and refractory lined;

a second chamber having a front end, a rear end and a substantially cylindrical longitudinally extending outer wall, the rear end of the first chamber in fluid communication with and substantially longitudinally aligned with the front end of the second chamber;

means for supplying air and fuel directly into the first chamber and for forming a cyclonic flow pattern of hot gases for combustion within the first chamber and the second chamber, with a Swirl number of at least about 0.7 and a Reynolds number of at least about 18,000 at the boiler maximum capacity;

a substantially cylindrical exit throat at the rear end of the second chamber and aligned substantially concentrically therewith, the exit throat having a diameter less than the inner diameter to the second chamber for inducing reverse flow zones within the first and second chambers; and heat exchange means surrounding the second chamber for substantially cooling the wall of the second chamber without substantially cooling the wall of the first chamber.

13. The boiler of claim 7 wherein the ratio of the diameter of the exit throat divided by the diameter of the inside surface of the second chamber lies within the range of about 0.4 to about 0.7.

14. A cyclonic combustor comprising:

a first chamber having a front end, a rear end and a substantially cylindrical longitudinally extending outer wall which is substantially uncooled and refractory lined;

a second chamber having a front end, a rear end and a substantially cylindrical longitudinally extending outer wall, the rear end of the first chamber in fluid communication with and substantially longitudinally aligned with the front end of the second chamber;

means for supplying air and fuel directly into the first chamber and for forming a cyclonic flow pattern for combustion within the first chamber and the second chamber;

a substantially cylindrical exit throat at the rear end of the second chamber and aligned substantially concentrically therewith, the exit throat having a diameter less than the inner diameter of the second chamber for inducing reverse flow zones within the first and second chambers; and means for substantially cooling the wall of the second chamber without substantially cooling the wall of the first chamber.

* * * * *